US008585573B2

(12) United States Patent
Edavana et al.

(10) Patent No.: US 8,585,573 B2
(45) Date of Patent: Nov. 19, 2013

(54) INFANT WARMER

(75) Inventors: Roopesh Edavana, Bangalore (IN); Ramkumar Meenakshisundaram, Bangalore (IN); Ronald N. Blaski, Wauwatosa, WI (US)

(73) Assignee: General Electric Company, Schenectady, NY (US)

( * ) Notice: Subject to any disclaimer, the term of this patent is extended or adjusted under 35 U.S.C. 154(b) by 812 days.

(21) Appl. No.: 12/629,713

(22) Filed: Dec. 2, 2009

(65) Prior Publication Data

US 2011/0130621 A1 Jun. 2, 2011

(51) Int. Cl.
*A61G 11/00* (2006.01)

(52) U.S. Cl.
USPC ..... 600/22

(58) Field of Classification Search
USPC ..... 600/22; 5/93.1, 97, 600, 603; 607/100
See application file for complete search history.

(56) References Cited

U.S. PATENT DOCUMENTS

| | | | | |
|---|---|---|---|---|
| 6,585,636 | B2 * | 7/2003 | Jones et al. | 600/22 |
| 6,666,815 | B2 | 12/2003 | Costanzo et al. | |
| 6,669,625 | B2 * | 12/2003 | Costanzo et al. | 600/22 |
| 7,070,188 | B2 * | 7/2006 | Waldman et al. | 280/31 |

* cited by examiner

*Primary Examiner* — Charles A Marmor, II
*Assistant Examiner* — Thaddeus Cox

(57) ABSTRACT

An infant warmer apparatus includes a base, a crib and a frame. The frame includes a support plate assembly comprising a plate member defining a pivot aperture and a notch. The heater assembly includes a canopy, and a mounting shaft. The mounting shaft defines a first terminal end secured to the canopy and a second terminal end passing through the pivot aperture of the plate member. The mounting shaft includes a biasing pin configured to settle within the notch of the plate member when the heater assembly is in a neutral position relative to the frame. The mounting shaft is rotatable within the pivot aperture such that the heater assembly can be pivoted in either a clockwise or counter-clockwise direction from the neutral position. A controller is configured to turn off the heater assembly when the heater assembly is pivoted out of the neutral position.

22 Claims, 5 Drawing Sheets

INFANT WARMER

BACKGROUND OF THE INVENTION

The subject matter disclosed herein relates to an infant warming apparatus with a pivotable heater assembly.

Warming devices may be implemented to warm an infant and to supply the necessary heat to maintain the infant at a predetermined temperature. Infant warmers commonly have an overhead radiant heater that is located above the infant and which thus radiates energy in the infrared spectrum to impinge upon the infant to maintain the predetermined temperature.

One problem with conventional infant warmers is that the heater assembly limits access to the infant. As an example, diagnostic and/or imaging equipment that is introduced from a vertical position above the infant can interfere with the heater assembly. It is therefore generally necessary to remove the infant from a conventional warmer device before implementing such diagnostic and/or imaging equipment. A more specific problem attributable conventional warmers is that they require a user to handle the infant during many diagnostic and/or imaging procedures, which can increase the risk of infection.

BRIEF DESCRIPTION OF THE INVENTION

The above-mentioned shortcomings, disadvantages and problems are addressed herein which will be understood by reading and understanding the following specification.

In an embodiment, an infant warmer includes a base, and a frame secured to the base. The frame includes a controller and a support plate assembly. The support plate assembly includes a plate member defining a pivot aperture and a notch. The infant also includes a crib and a heater assembly that are secured to the frame. The heater assembly includes a canopy, and a mounting shaft. The mounting shaft defines a first terminal end secured to the canopy and a second terminal end passing through the pivot aperture of the plate member. The mounting shaft includes a biasing pin configured to settle within the notch of the plate member when the heater assembly is in a neutral position relative to the frame. The mounting shaft is rotatable within the pivot aperture such that the heater assembly can be pivoted in either a clockwise or counter-clockwise direction from the neutral position. The controller is configured to turn off the heater assembly when the heater assembly is pivoted out of the neutral position.

In another embodiment, an infant warmer includes a base, and a frame secured to the base. The frame includes a support plate assembly comprising a plate member defining a pivot aperture and a notch. The support plate assembly also comprises a locking pin secured to the plate member, and a spring disposed about the periphery of the locking pin. The infant warmer also includes a crib and a heater assembly secured to the frame. The heater assembly includes a canopy, and a mounting shaft. The mounting shaft defines a first terminal end secured to the canopy and a second terminal end passing through the pivot aperture of the plate member. The mounting shaft includes a biasing pin configured to settle within the notch of the plate member when the heater assembly is in a neutral position relative to the frame. The mounting shaft also includes a locking aperture adapted to receive the locking pin. The spring is configured to bias the locking pin into a locked position within the locking aperture. The locking pin is translatable into an unlocked position under the influence of an external force exceeding that of the spring bias. The heater assembly is locked into the neutral position when the locking pin is in the locked position. The heater assembly is pivotable in either a clockwise or counter-clockwise direction from the neutral position when the locking pin is in the unlocked position.

Various other features, objects, and advantages of the invention will be made apparent to those skilled in the art from the accompanying drawings and detailed description thereof.

DETAILED DESCRIPTION OF THE INVENTION

In the following detailed description, reference is made to the accompanying drawings that form a part hereof, and in which is shown by way of illustration specific embodiments that may be practiced. These embodiments are described in sufficient detail to enable those skilled in the art to practice the embodiments, and it is to be understood that other embodiments may be utilized and that logical, mechanical, electrical and other changes may be made without departing from the scope of the embodiments. The following detailed description is, therefore, not to be taken as limiting the scope of the invention.

Figure 1:
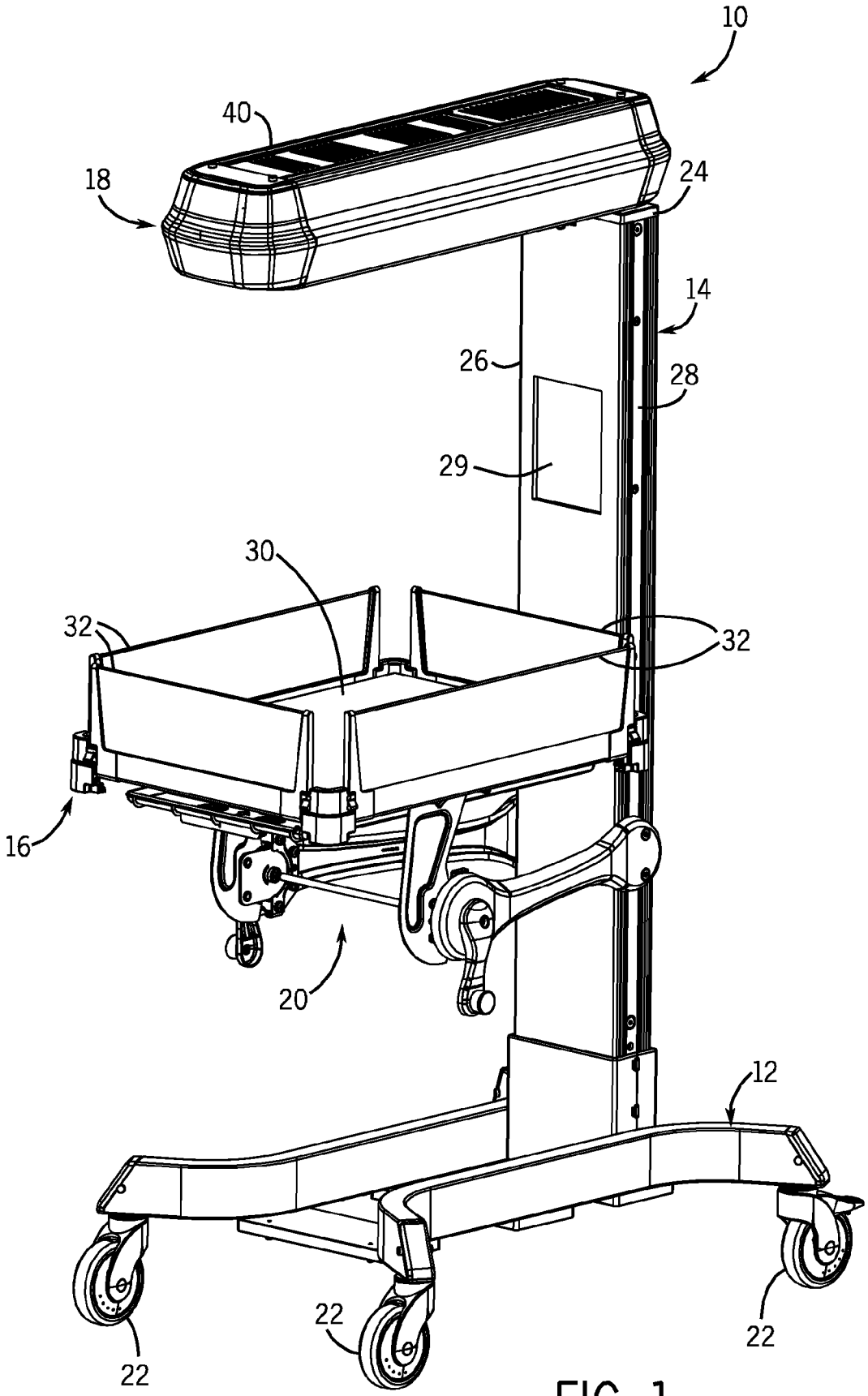
FIG. 1 is an isometric illustration of an infant warmer in accordance with an embodiment.

Referring to FIG. 1, an isometric illustration depicts an infant warmer 10 in accordance with one embodiment. The infant warmer 10 may include a base 12, a frame 14, a partially enclosed infant retainer or crib 16, and a heater assembly 18. The infant warmer 10 may also optionally include a crib adjustment device 20. It should be appreciated that the infant warmer 10 is being described in accordance with an embodiment, and that other configurations may be envisioned.

The base 12 may include a plurality of wheels 22 adapted to facilitate translation of the infant warmer 10. The frame 14 is secured to and extends away from the base 12 in a vertical direction. According to one embodiment, the frame 14 comprises a support plate assembly 24 disposed at a terminal end portion opposite the base 12. According to an alternate embodiment, the support plate assembly 24 is secured directly to a wall in a known manner (e.g., with a mounting bracket). In this alternate embodiment, the infant warmer 10 becomes a wall-mounted infant warmer. The frame 14 also comprises a pair of generally opposed parallel rails 26, 28. The frame 14 may optionally comprise a controller 29 configured to regulate the operation of the infant warmer 10.

According to the depicted embodiment, the crib 16 is mounted to the crib adjustment device 20, however the crib 16 may alternatively be mounted directly to the frame rails 26, 28. The crib 16 includes a generally rectangular infant pedestal 30 that underlies and supports an infant. The crib 16 also includes a plurality of walls 32 disposed on all four sides of the infant pedestal 30. The walls 32 are provided to contain the infant safely within the infant warming apparatus 10. The crib adjustment device 20 is an optional component that may be secured to the frame rails 26, 28 and the crib 16 in order to adjust the orientation of the crib 16.

The heater assembly 18 is secured to the frame 14 as will hereinafter be described in detail. The heater assembly 18 will be described as a radiant heater configured to provide radiant energy in the infrared spectrum to impinge upon an infant disposed within the crib 16. It should, however, be appreciated that the infant warmer 10 could be configured to implement a variety of different heater types and configurations.

Figure 2:
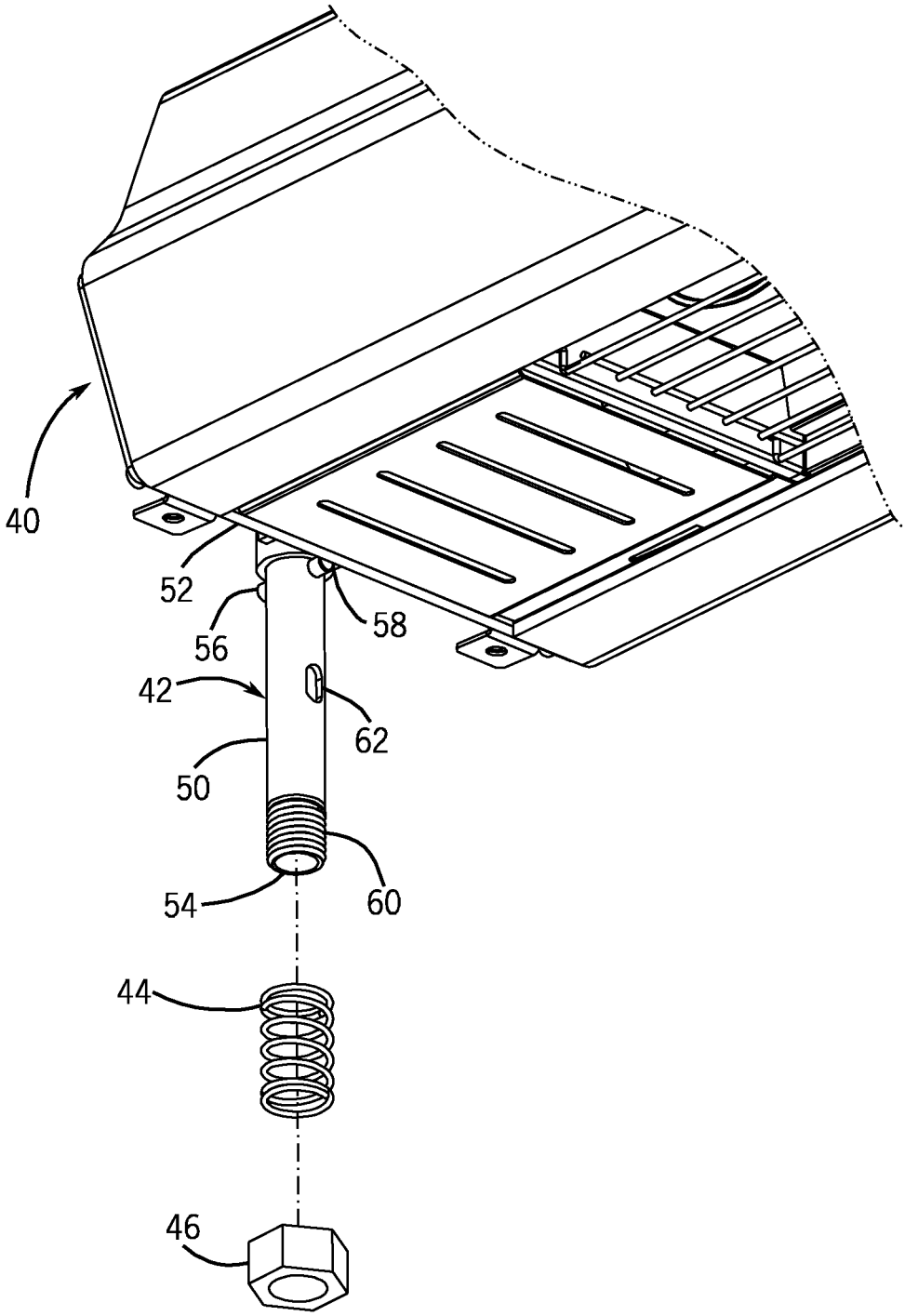
FIG. 2 is an isometric exploded view of a heater assembly of the infant warmer of FIG. 1 in accordance with an embodiment.

Referring to FIG. 2, an isometric exploded view depicts the heater assembly 18 in accordance with an embodiment. The heater assembly 18 includes a canopy 40, a mounting shaft 42, a helical spring 44, and a nut 46.

The mounting shaft 42 includes a generally cylindrical body portion 50 defining a first terminal end portion 52 and an oppositely disposed second terminal end 54. The mounting shaft 42 includes a first biasing pin 56 and a second biasing pin 58. The first and second biasing pins 56, 58 are aligned with each other, and extend away from the outer surface of the cylindrical body portion 50 in generally opposite directions. According to alternate embodiments, the mounting shaft 42 may include a single biasing pin (not shown). The mounting shaft 42 also includes a threaded section 60 disposed at the second terminal end 54. The mounting shaft 42 also includes a locking aperture 62 disposed approximately halfway between the terminal ends 52, 54.

The cylindrical body portion 50 of the mounting shaft 42 is adapted for insertion through the helix defined by the spring 44. The cylindrical body portion 50 is similarly insertable through the nut 46 such that the nut 46 engages the threaded section 60.

Figure 3:
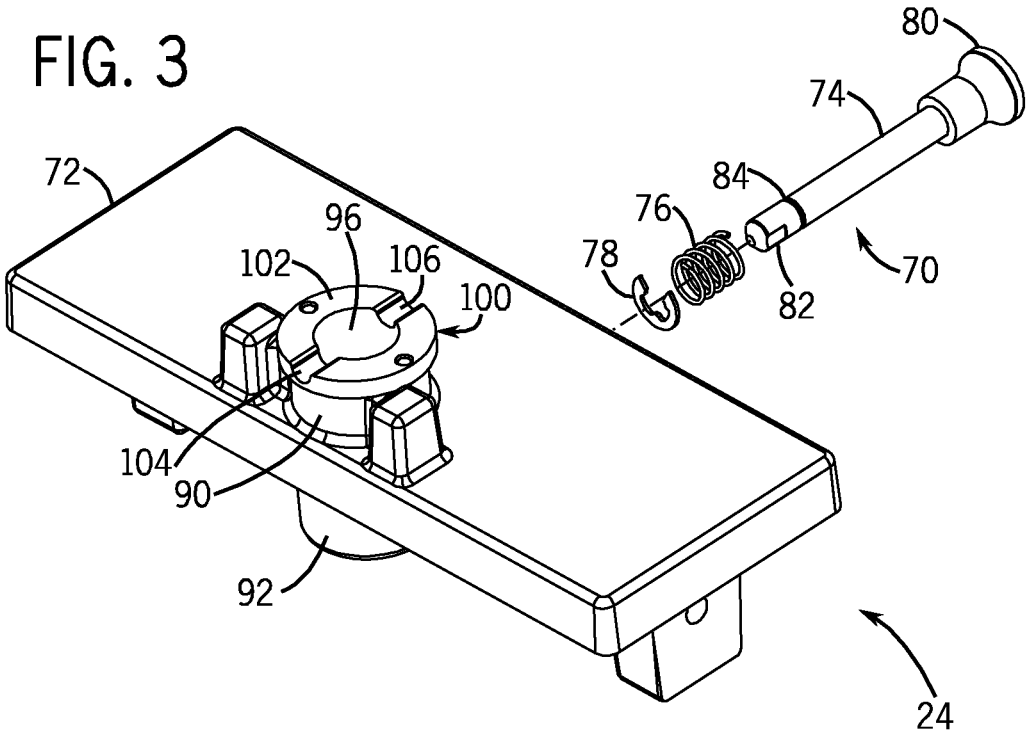
FIG. 3 is a top isometric exploded view of a support plate assembly of the infant warmer of FIG. 1 in accordance with an embodiment.

Referring to FIG. 3, a top isometric exploded view depicts the support plate assembly 24 in accordance with an embodiment. As previously indicated, the support plate assembly 24 is a component of the frame 14 (shown in FIG. 1). The support plate assembly 24 includes a locking pin assembly 70 and a plate member 72.

The locking pin assembly 70 includes a generally cylindrical locking pin 74, a helical spring 76, and a circlip 78. The locking pin 74 includes a knob 80 disposed at one terminal end, and a reduced diameter portion 82 at an opposite terminal end. The locking pin 74 comprises a narrow groove 84 defined around its outer circumference, and positioned in close proximity to the reduced diameter portion 82 as measured in an axial direction. The groove 84 is configured to accommodate the circlip 78.

Figure 4:
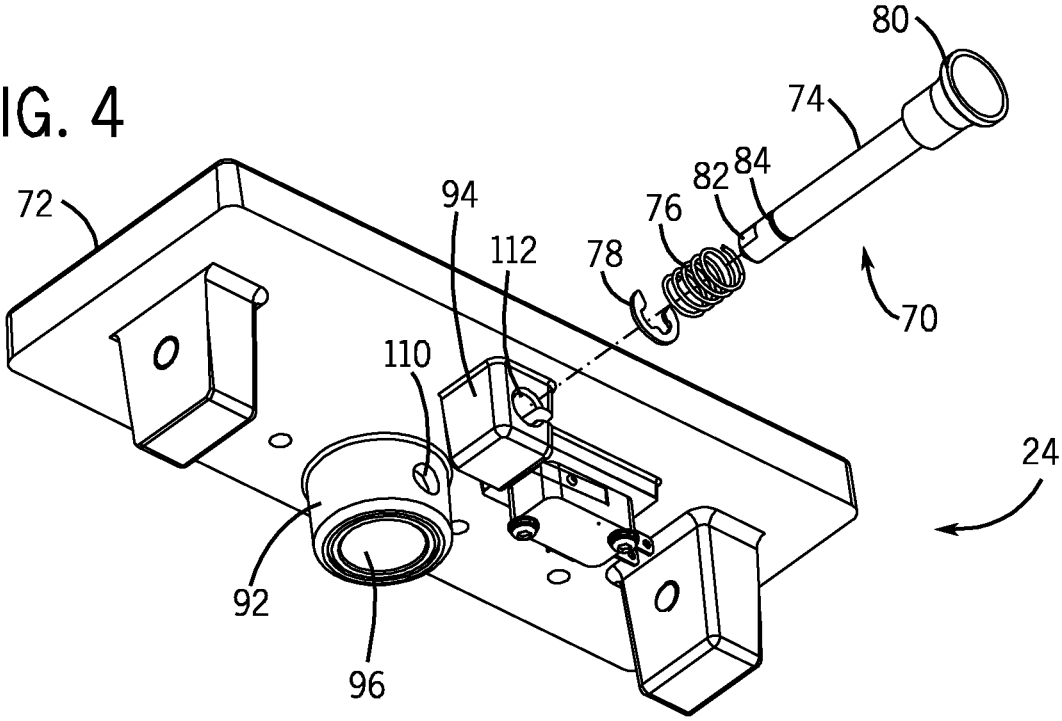
FIG. 4 is a bottom isometric exploded view of the support plate assembly of FIG. 3 in accordance with an embodiment.

The plate member 72 is generally rectangular. The plate member defines a first cylindrical protrusion 90, a second cylindrical protrusion 92 and a rectangular protrusion 94 (shown in FIG. 4). The first cylindrical protrusion 90 extends in an upward direction from the top surface of the plate member 72. The second cylindrical protrusion 92 and the rectangular protrusion 94 extend in a downward direction from the bottom surface of the plate member 72 (as best shown in FIG. 4). A pivot aperture 96 is defined through the first and second cylindrical protrusions 90, 92. The pivot aperture 96 is adapted to accommodate the heater assembly mounting shaft 42 (shown in FIG. 2) in a manner that allows the heater assembly 18 (shown in FIG. 2) to pivot relative to the frame 14 (shown in FIG. 1).

The first cylindrical protrusion 90 of the plate member 72 comprises an annular bearing 100 positioned at an uppermost terminal end portion. The bearing 100 comprises a top surface 102, a first notch 104 and a second notch 106. The first and second notches 104, 106 are generally aligned in a radial direction. The first and second notches 104, 106 are sized and configured to retain the first and second biasing pins 56, 58, respectively.

Referring to FIG. 4, a bottom isometric exploded view depicts the support plate assembly 24 in accordance with an embodiment. FIG. 4 is intended to show the second cylindrical protrusion 92 and the rectangular protrusion 94 of the plate member 72 in more detail. The second cylindrical protrusion 92 comprises a locking aperture 110 sized and configured to receive the reduced diameter portion 82 of the locking pin 74. The rectangular protrusion 94 comprises a pass-through aperture 112 sized and configured to receive the body of the locking pin 74. The locking aperture 110 is in alignment with the pass-through aperture 112.

Figure 5:
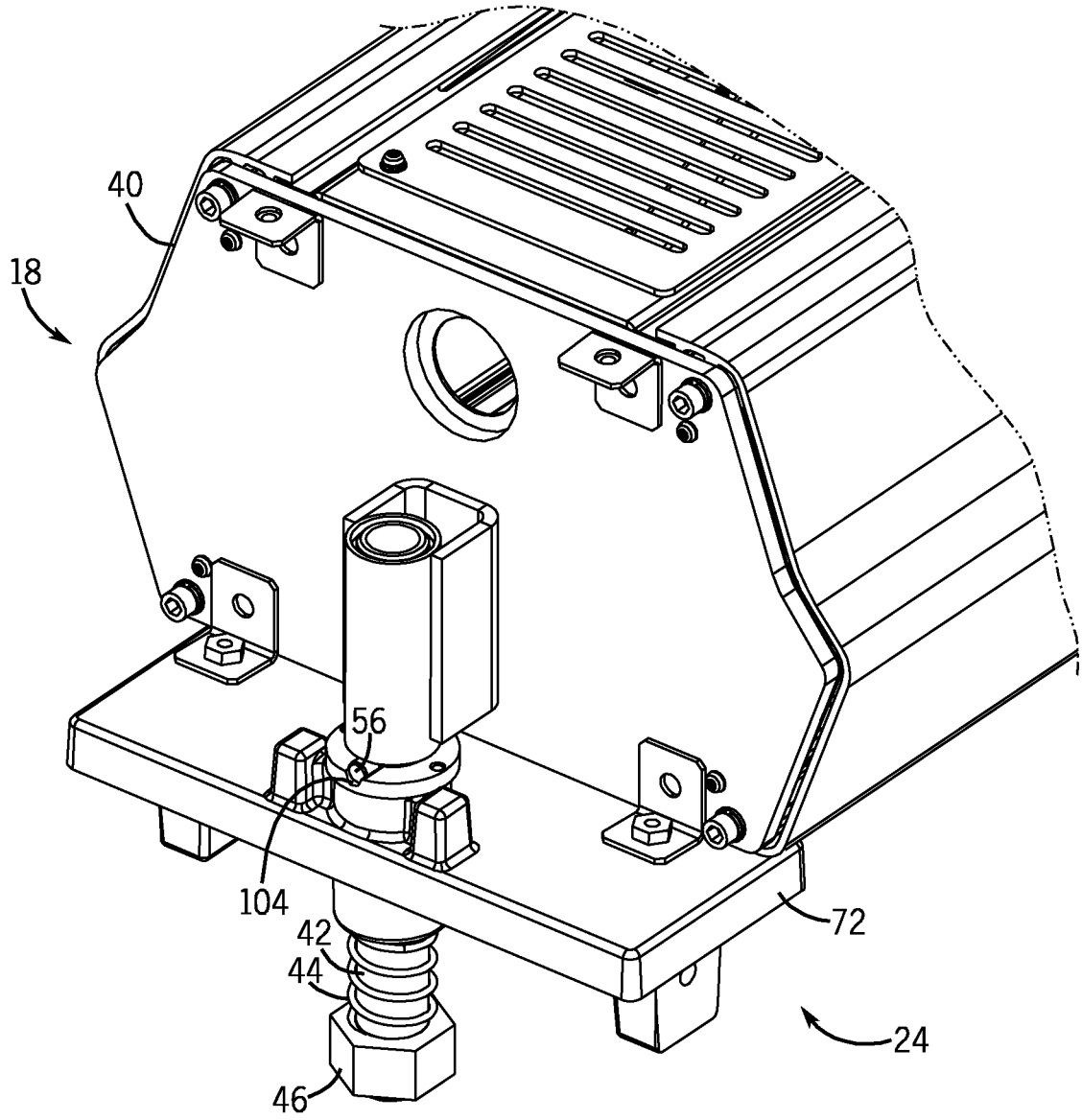
FIG. 5 is a top isometric view of the heater assembly of FIG. 2 mounted to the support plate assembly of FIG. 3 in accordance with an embodiment.

Referring to FIG. 5, a top isometric view depicts the heater assembly 18 and the support plate assembly 24 mounted together and in their assembled state. It can be seen in this figure that, when assembled, the mounting shaft 42 of the heater assembly 18 passes through the pivot aperture 96 (shown in FIGS. 3 and 4) defined by the plate member 72. After passing through the pivot aperture 96, the mounting shaft 42 is inserted through the helix defined by the spring 44 and into the nut 46. As the nut 46 is screwed onto the threaded section 60 (shown in FIG. 2) of the mounting shaft 42, the spring 44 becomes compressed. Spring 44 compression generates a pre-load that biases the heater assembly 18 into engagement with the support plate assembly 24.

The heater assembly 18 is depicted in FIGS. 1 and 5 in its neutral position in which the heater assembly 18 is generally centered above the crib 16, and the first and second biasing pins 56, 58 are disposed in the first and second notches 104, 106, respectively. It should be appreciated that the spring 44 pre-load that biases the heater assembly 18 into engagement with the support plate assembly 24 also has the effect of maintaining the first and second biasing pins 56, 58 respectively within the first and second notches 104, 106 such that the heater assembly 18 is biased into its neutral position.

If a user wants greater access to an infant in the crib 16 they can push or pull the canopy 40 such that the mounting shaft 42 swivels within the pivot aperture 96 (shown in FIGS. 3 and 4) defined by the plate member 72, and the heater assembly 18 will be correspondingly pivoted relative to the frame 14. It should be appreciated that the heater assembly 18 can be pivoted in either a clockwise or a counter-clockwise direction depending on the needs of a given user. When the heater assembly 18 is pivoted in the manner described, the user applied force acts to vertically lift the biasing pins 56, 58 out of their respective notches 104, 106 such that the spring 44 becomes further compressed. According to one embodiment, the controller 29 (shown in FIG. 1) turns off the heater assembly 18 when the heater assembly 18 is pivoted out of its neutral position such that adjacent personnel and/or devices are not exposed to the generated heat.

Figure 6:
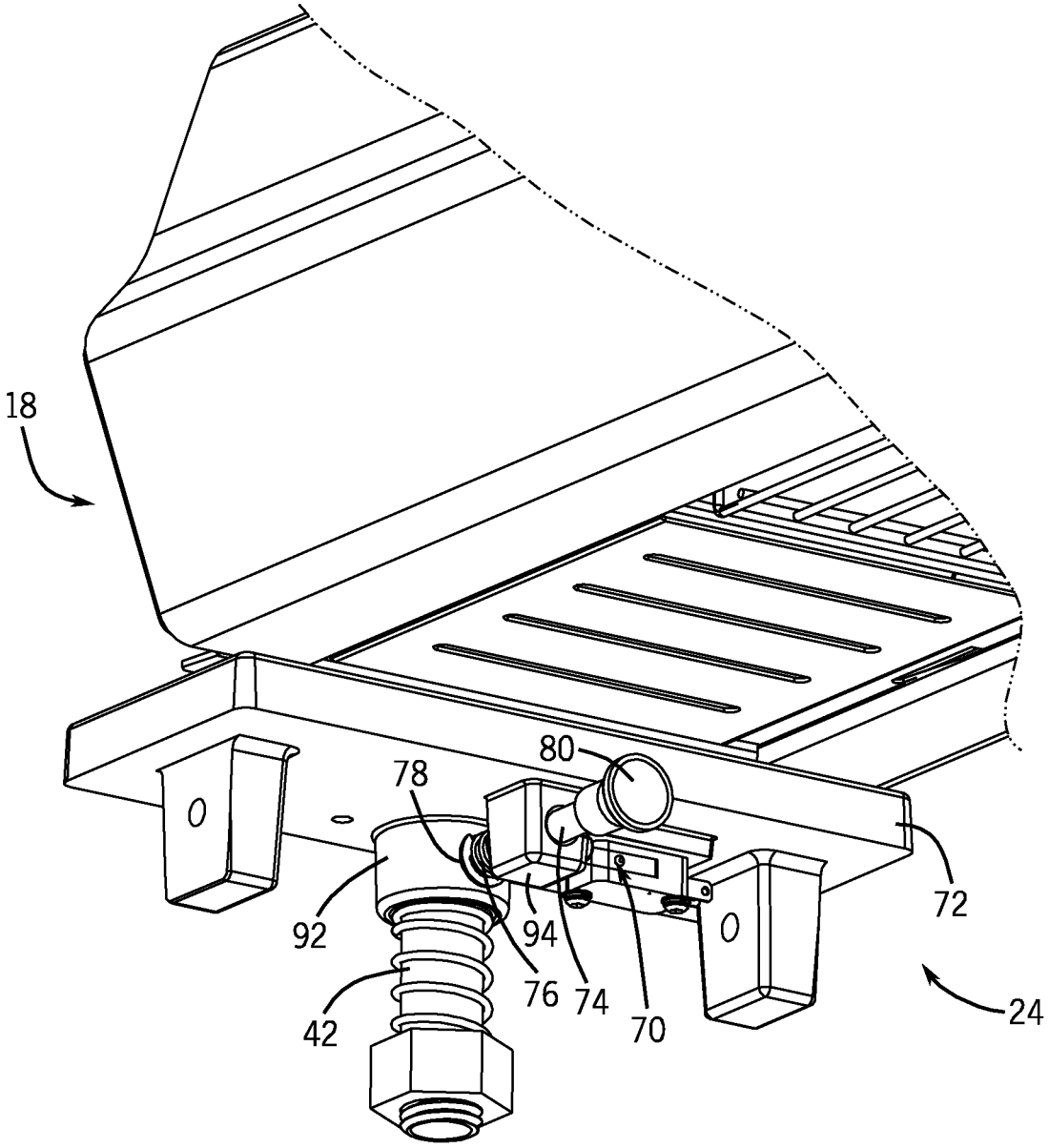
FIG. 6 is a bottom isometric view of the heater assembly of FIG. 2 mounted to the support plate assembly of FIG. 3 in accordance with an embodiment.

Referring to FIG. 6, a bottom isometric view depicts the heater assembly 18 and the support plate assembly 24 mounted together and in their assembled state. FIG. 6 is intended to depict the locking pin assembly 70 in more detail. It can be seen that, in its assembled state, the locking pin 74 passes through the pass-through aperture 112 (shown in FIG. 4) defined by the rectangular protrusion 94. After passing through the pass-through aperture 112, the locking pin 74 is inserted through the helix defined by the spring 76, through the locking aperture 110 (shown in FIG. 4) of the cylindrical protrusion 92, and into the locking aperture 62 of the mounting shaft 42 (shown in FIG. 2). The circlip 78 is then snapped onto the locking pin 74 within the groove 84 (shown in FIG. 4) such that the spring 76 is slightly compressed and disposed axially between the circlip 78 and the rectangular protrusion 94.

It should be appreciated that the previously described compression of spring 76 has the effect of pushing the circlip 78, and the locking pin 74 to which the circlip 78 is secured, away from the rectangular protrusion 94. Pushing the locking pin 74 in the manner described has the effect of biasing the reduced diameter portion 82 (shown in FIG. 4) of the locking pin 74 into its locked position within the locking aperture 62 of the mounting shaft 42. It should also be appreciated that, when the locking pin 74 is in its locked position, the heater assembly 18 is locked into in its neutral position and cannot be pivoted relative to the frame 14 (shown in FIG. 1). A user can move the locking pin 74 to its unlocked position by pulling axially on the knob 80. More precisely, pulling axially on the knob 80 translates the locking pin 74 away from the mounting shaft 42 such that the reduced diameter portion 82 of the locking pin 74 is extracted from the locking aperture 62 (shown in FIG. 2) of the mounting shaft 42. When the locking pin 74 is in its unlocked position, the heater assembly 18 is free to pivot in a clockwise or counter-clockwise direction relative to the frame 14.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

We claim:

1. An infant warmer comprising:
- a base;
- a frame secured to the base, said frame comprising a controller and a support plate assembly, said support plate assembly comprising a plate member defining a pivot aperture and a notch;
- a crib secured to the frame; and
- a heater assembly secured to the frame, said heater assembly comprising:
  - a canopy;
  - a mounting shaft defining a first terminal end secured to the canopy and a second terminal end passing through the pivot aperture of the plate member, said mounting shaft comprising:
    - a biasing pin configured to settle within the notch of the plate member when the heater assembly is in a neutral position relative to the frame;
- wherein the mounting shaft is rotatable within the pivot aperture such that the heater assembly can be pivoted in either a clockwise or counter-clockwise direction from the neutral position; and
- wherein the controller is configured to turn off the heater assembly when the heater assembly is pivoted out of the neutral position.

2. The infant warmer of claim 1, wherein the base comprises a plurality of wheels.

3. The infant warmer of claim 1, wherein the frame comprises a plurality of rails.

4. The infant warmer of claim 1, wherein the crib comprises a generally rectangular infant pedestal and a plurality of walls disposed on all four sides of the infant pedestal.

5. The infant warmer of claim 1, wherein the support plate assembly comprises a locking pin secured to the plate member, and wherein the mounting shaft comprises a locking aperture adapted to receive the locking pin.

6. The infant warmer of claim 5, wherein the support plate assembly comprises a spring configured to bias the locking pin into a locked position within the locking aperture, and wherein the locking pin is translatable into an unlocked position under the influence of an external force exceeding that of the spring bias.

7. The infant warmer of claim 6, wherein the locking pin comprises a knob adapted to facilitate the translation into the unlocked position.

8. The infant warmer of claim 1, wherein the heater assembly comprises a radiant heater configured to provide radiant energy in the infrared spectrum to impinge upon an infant disposed within the crib.

9. The infant warmer of claim 1, wherein the heater assembly comprises a spring configured to generate a pre-load that retains the biasing pin within the notch of the plate member.

10. An infant warmer comprising:
- a base;
- a frame secured to the base, said frame comprising a support plate assembly, said support plate assembly comprising:
  - a plate member defining a pivot aperture and a notch;
  - a locking pin secured to the plate member; and
  - a spring disposed about a periphery of the locking pin;
- a crib secured to the frame; and
- a heater assembly secured to the frame, said heater assembly comprising:
  - a canopy;
  - a mounting shaft defining a first terminal end secured to the canopy and a second terminal end passing through the pivot aperture of the plate member, said mounting shaft comprising:
    - a biasing pin configured to settle within the notch of the plate member when the heater assembly is in a neutral position relative to the frame;
  - a locking aperture adapted to receive the locking pin;
- wherein the spring is configured to bias the locking pin into a locked position within the locking aperture, and wherein the locking pin is translatable into an unlocked position under the influence of an external force exceeding that of the spring bias;
- wherein the heater assembly is locked into the neutral position when the locking pin is in the locked position; and
- wherein the heater assembly is pivotable in either a clockwise or counter-clockwise direction from the neutral position when the locking pin is in the unlocked position.

11. The infant warmer of claim 10, wherein the base comprises a plurality of wheels.

12. The infant warmer of claim 10, wherein the frame comprises a plurality of rails.

13. The infant warmer of claim 10, wherein the frame comprises a controller configured to turn off the heater assembly when the heater assembly is pivoted out of the neutral position.

14. The infant warmer of claim 10, wherein the crib comprises a generally rectangular infant pedestal and a plurality of walls disposed on all four sides of the infant pedestal.

15. The infant warmer of claim 10, wherein the heater assembly comprises a radiant heater configured to provide radiant energy in the infrared spectrum to impinge upon an infant disposed within the crib.

16. The infant warmer of claim 10, wherein the heater assembly comprises a second spring configured to generate a pre-load that retains the biasing pin within the notch of the plate member.

17. An infant warmer comprising:

a support plate assembly comprising a plate member defining a pivot aperture and a notch; and a heater assembly secured to the support plate assembly, said heater assembly comprising:

a canopy;

a mounting shaft defining a first terminal end secured to the canopy and a second terminal end passing through the pivot aperture of the plate member, said mounting shaft comprising:

a biasing pin configured to settle within the notch of the plate member when the heater assembly is in a neutral position;

wherein the mounting shaft is rotatable within the pivot aperture such that the heater assembly can be pivoted in either a clockwise or counter-clockwise direction from the neutral position; and wherein a controller is configured to turn off the heater assembly when the heater assembly is pivoted out of the neutral position.

18. The infant warmer of claim 17, wherein the support plate assembly comprises a locking pin secured to the plate member, and wherein the mounting shaft comprises a locking aperture adapted to receive the locking pin.

19. The infant warmer of claim 18, wherein the support plate assembly comprises a spring configured to bias the locking pin into a locked position within the locking aperture, and wherein the locking pin is translatable into an unlocked position under the influence of an external force exceeding that of the spring bias.

20. The infant warmer of claim 17, wherein the heater assembly comprises a radiant heater configured to provide radiant energy in the infrared spectrum to impinge upon an infant disposed within a crib.

21. The infant warmer of claim 9, wherein the biasing pin is configured such that the pre-load can be overcome by a user applying a rotational force on the heater assembly.

22. The infant warmer of claim 16, wherein the biasing pin is configured such that the pre-load can be overcome by a user applying a rotational force on the heater assembly.

* * * * *